US007819495B2

(12) United States Patent
Ito et al.

(10) Patent No.: US 7,819,495 B2
(45) Date of Patent: Oct. 26, 2010

(54) PRINT METHOD, PRINT APPARATUS, AND RECORDING MEDIUM DRIVING APPARATUS

(75) Inventors: Tatsumi Ito, Kanagawa (JP); Takeshi Matsui, Tokyo (JP); Yuichiro Ikemoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 239 days.

(21) Appl. No.: 11/986,286

(22) Filed: Nov. 20, 2007

(65) Prior Publication Data

US 2008/0238960 A1 Oct. 2, 2008

(30) Foreign Application Priority Data

Dec. 1, 2006 (JP) ..... 2006-326264

(51) Int. Cl.
*B41J 2/205* (2006.01)

(52) U.S. Cl. ..... 347/15; 347/2; 347/12; 347/14; 347/19; 347/43; 358/1.2; 358/1.9

(58) Field of Classification Search ..... None
See application file for complete search history.

(56) References Cited

U.S. PATENT DOCUMENTS

| | | | | |
|---|---|---|---|---|
| 6,554,389 | B1 * | 4/2003 | Hawkins et al. | 347/19 |
| 2004/0104951 | A1 * | 6/2004 | Shibata et al. | 347/14 |
| 2004/0136291 | A1 * | 7/2004 | Hayashi | 369/53.2 |
| 2006/0221102 | A1 * | 10/2006 | Sugahara | 347/8 |
| 2007/0024662 | A1 * | 2/2007 | Arazaki | 347/19 |
| 2008/0018680 | A1 | 1/2008 | Ito et al. | |
| 2008/0018689 | A1 | 1/2008 | Ito et al. | |

FOREIGN PATENT DOCUMENTS

| | | | |
|---|---|---|---|
| JP | 09-265760 | A | 10/1997 |
| JP | 2002-251862 | A | 6/2002 |
| JP | 2004-110994 | A | 4/2004 |
| JP | 2004-114357 | A | 4/2004 |
| JP | 2005-205636 | A | 8/2004 |
| JP | 2006-231701 | A | 9/2006 |
| JP | 2006-318539 | A | 11/2006 |

* cited by examiner

*Primary Examiner*—Matthew Luu
*Assistant Examiner*—Justin Seo
(74) *Attorney, Agent, or Firm*—Wolf, Greenfield & Sacks, P.C.

(57) ABSTRACT

A print method that prints visible information by ejecting ink droplets from a print head onto a printed object rotated by a rotational driving unit is provided. The print method includes the steps of: carrying out impact position correction that corrects displacements in impact positions of the ink droplets to convert the visible information to impact position-corrected polar coordinate data when converting the visible information from biaxial perpendicular coordinate data to polar coordinate data; generating ink ejection data based on the impact position-corrected polar coordinate data; and printing the visible information by ejecting the ink droplets onto the printed object based on the ink ejection data.

6 Claims, 11 Drawing Sheets

ABCDEFGH

ABCDEFGH
Y
X

ABCDEFGH
r
θ

Dot Density Correction
W=1.0
Floyd & Steinberg Error Diffusion
Dot Density Correction
W=0.5
Floyd & Steinberg Error Diffusion
r
θ
A1 A2 A3 A4 A5 A6 A7 A8
B1 B2 B3 B4 B5 B6 B7 B8
C1 C2 C3 C4 C5 C6 C7 C8
D1 D2 D3 D4 D5 D6 D7 D8
E1 E2 E3 E4 E5 E6 E7 E8
F1 F2 F3 F4 F5 F6 F7 F8
255
127
0

PRINT METHOD, PRINT APPARATUS, AND RECORDING MEDIUM DRIVING APPARATUS

CROSS REFERENCES TO RELATED APPLICATIONS

The present invention contains subject matter related to Japanese Patent Application JP 2006-326264 filed in the Japanese Patent Office on Dec. 1, 2006, the entire contents of which being incorporated herein by reference.

BACKGROUND OF THE INVENTION

1. Field of the Invention

The present invention relates to a print method that rotates a disc-shaped recording medium, such as a CD-R (Compact Disc-Recordable) or a DVD-RW (Digital Versatile Disc-Rewritable), a semiconductor storage medium, or other printed object and prints visible information such as characters and designs by ejecting ink droplets onto a label surface or other print surface of the rotating printed object, and also relates to a print apparatus and recording medium driving apparatus that use such print method.

2. Description of the Related Art

Japanese Unexamined Patent Application Publication No. 09-265760 (JP 09-265760 A) discloses an example of a print apparatus that uses such print method. JP 09-265760 A relates to an optical disc apparatus that is capable of printing on a removable optical disc. The optical disc apparatus disclosed in JP 09-265760 A is an information storage apparatus that can carry out at least one of the recording and the reproduction of information using a removable optical disc. The apparatus includes: a print head that prints on the optical disc; a print head driving unit that moves the print head in the radial direction of the optical disc; a spindle motor that rotates the optical disc; and a control unit that controls the print head, the print head driving unit, and the spindle motor, wherein the control unit causes the print head to scan across the optical disc to print on the optical disc.

The optical disc apparatus disclosed in JP 09-265760 A constructed as described above has a stated effect of making it possible to print a label on an optical disc without having to separately provide a dedicated label printer and with the disc still inserted in the optical disc apparatus (see Paragraph [0059]).

However, the optical disc apparatus disclosed by JP 09-265760 A is constructed so as to print visible information on the label surface of an optical disc by ejecting ink droplets from ejection nozzles provided on a print head onto a rotating optical disc. Also, with an apparatus of this construction, there has been the problem that when printing is carried out with a constant rotational velocity for the optical disc and constant timing for the ejecting of ink droplets by the print head, the rotation of the optical disc causes displacements to occur in the impact positions of the ink droplets.

Japanese Unexamined Patent Application Publication No. 2004-330497 (JP 2004-330497 A) discloses an example of a print apparatus that can correct such displacements in the impact positions of the ink droplets. JP 2004-330497 A relates to a liquid ejecting apparatus. The liquid ejecting apparatus disclosed by JP 2004-330497 A includes a nozzle row where a plurality of nozzles for ejecting liquid to form dots on a medium are disposed in a row, and emits liquid from the nozzles to form a correction pattern on the medium, the correction pattern having a difference in darkness in the main scanning direction so that displacements in dot formation positions in the main scanning direction can be corrected based on the difference in darkness. In the apparatus, when liquid is emitted from the nozzles to form the correction pattern, at least two of the nozzles out of the plurality of nozzles that construct the nozzle row emit liquid at a different timing for each nozzle.

The liquid ejecting apparatus disclosed by JP 2004-330497 A with the construction described above has stated effects such as being able to form a correction pattern that makes it possible to accurately correct displacements in the dot formation positions in the main scanning direction (see paragraph [0092]).

The liquid ejecting apparatus disclosed by JP 2004-330497 A is constructed with an ejection head that scans in the main scanning direction and carries out printing on a print sheet that is conveyed in the subscanning direction, which is perpendicular to the main scanning direction, by ejecting ink droplets while making both a forward pass and a return pass in the main scanning direction. The correction pattern is formed before printing and displacements in the dot formation positions in the main scanning direction are corrected by matching up the timing at which ink droplets are ejected during the forward pass with the timing at which ink droplets are ejected during the return pass based on the correction pattern. In this way, the liquid ejecting apparatus disclosed by JP 2004-330497 A may not print on a rotating printed object and therefore may be not able to correct displacements in impact positions caused by ink droplets landing on a rotating printed object.

Next, displacements in impact positions due to ink droplets landing on a rotating printed object will be described with reference to FIGS. 1A and 1B. FIG. 1A shows a label surface 101*a* of an optical disc 101 such as a CD-R as a specific example of a printed object and a print head 102 from which ink droplets 103 are ejected. As shown in FIG. 1A, in the present example the print head 102 has eight ejection nozzles that are aligned in the radial direction of the optical disc 101. When the ink droplets 103 are ejected from the respective ejection nozzles, a total of eight ink droplets 103 land on the label surface 101*a*. FIG. 1B shows the case where printing has been carried out by ejecting the ink droplets 103 with a constant ejection timing using this type of print head 102 while rotating the optical disc 101 at a constant rotational velocity.

As shown in FIG. 1B, when printing is carried out with a constant rotational velocity for the optical disc 101 and constant timing for the ejecting of the ink droplets 103, the ink droplets 103 that are ejected in a line in the radial direction of the optical disc 101 will impact positions that are displaced in both the radial direction of the optical disc 101 and an angular direction measured relative to the origin for rotation angles. This displacement in the impact positions increases toward the outer periphery of the optical disc 101. This phenomenon occurs since the rotation of the optical disc 101 produces air flows in the periphery of the optical disc 101 and such air flows affect the ink droplets.

For example, if the radius of a dripped ink droplet 103 is expressed as a and the velocity of an air flow as v, the force F that acts on the ink droplet 103 due to such air flow is calculated by $$F=6\pi\mu va \text{(Stokes drag)}$$

where μ is the viscosity modulus of air.

The velocity v of an air flow produced in the periphery of the optical disc 101 increases toward the outer periphery of the optical disc 101. That is, the force F that acts due to an air flow is larger for an ink droplet 103 ejected at the outer periphery of the optical disc 101 than for an ink droplet 103 ejected at the inner periphery. Hence, different displacements occur in the impact positions of the ink droplets 103 according to the positions of such ink droplets 103 in the radial direction of the optical disc 101. As a result, distortion occurs in the printed visible information, which leads to a reduction in print quality.

SUMMARY OF THE INVENTION

For a print apparatus that prints visible information on a print surface of a rotating printed object by ejecting ink droplets onto the printed object from ejection nozzles provided on a print head, the rotation of the printed object causes displacement in the impact positions of the ink droplets and distortion in the printed visible information, thereby leading to a reduction in print quality.

It is desirable to provide a print method, a print apparatus, and a recording medium driving apparatus that can prevent distortion occurring for printed visible information when visible information is printed by ejecting ink droplets onto a rotating printed object and can therefore print with high quality.

According to an embodiment of the present invention, there is provided a print method that prints visible information by ejecting ink droplets from a print head onto a printed object that is rotated by a rotational driving unit. When converting the visible information from biaxial perpendicular coordinate data to polar coordinate data, the print method carries out impact position correction that corrects displacements in impact positions of the ink droplets to convert the visible information to impact position-corrected polar coordinate data. The method then generates ink ejection data based on the impact position-corrected polar coordinate data, and prints the visible information by ejecting the ink droplets onto the printed object based on the ink ejection data.

According to another embodiment of the present invention, there is provided a print apparatus including: a rotational driving unit, a print head, and a control unit. The rotational driving unit rotates a printed object. The print head prints visible information by ejecting ink droplets onto the printed object being rotated by the rotational driving unit. The control unit generates ink ejection data based on the visible information and controls the print head based on the ink ejection data. When converting the visible information, which is expressed using biaxial perpendicular coordinate data, to polar coordinate data, the control unit of the print apparatus carries out impact position correction to correct displacements in impact positions of the ink droplets and generate impact position-corrected polar coordinate data, and generates the ink ejection data based on the impact position-corrected polar coordinate data.

According to further another embodiment of the present invention, there is provided a recording medium driving apparatus including: a reading unit, a rotational driving unit, a print head and a control unit. The reading unit reads information from a recording surface of a recording medium. The rotational driving unit rotates the recording medium. The print head prints visible information by ejecting ink droplets onto a label surface of the recording medium being rotated by the rotational driving unit. The control unit generates ink ejection data based on the visible information and controls the print head based on the ink ejection data and position data for the recording medium obtained from the information read by the reading unit. When converting the visible information, which is expressed using biaxial perpendicular coordinate data, to polar coordinate data, the control unit of the recording medium driving apparatus carries out impact position correction to correct displacements in impact positions of the ink droplets and generate impact position-corrected polar coordinate data, and generates the ink ejection data based on the impact position-corrected polar coordinate data.

The print method, print apparatus, and recording medium driving apparatus according to the embodiments of the present invention can carry out printing that compensates for displacements in the impact positions of ink droplets and can thereby prevent distortion in the visible information printed on the printed object.

DESCRIPTION OF THE PREFERRED EMBODIMENTS

A print method, a print apparatus, and a recording medium driving apparatus which are operable, when converting visible information expressed using biaxial perpendicular coordinate data to polar coordinate data, to carry out impact position correction to correct displacements in the impact positions of ink droplets and generate impact position-corrected polar coordinate data, are obtained with a simple construction. Such method and apparatuses can prevent distortion in the visible information printed on a printed object and therefore print with high quality.

Preferred embodiments of a print method, a print apparatus, and a recording medium driving apparatus according to the present invention will now be described with reference to the attached drawings, however, the present invention is not limited to such embodiments.

Figure 1A:
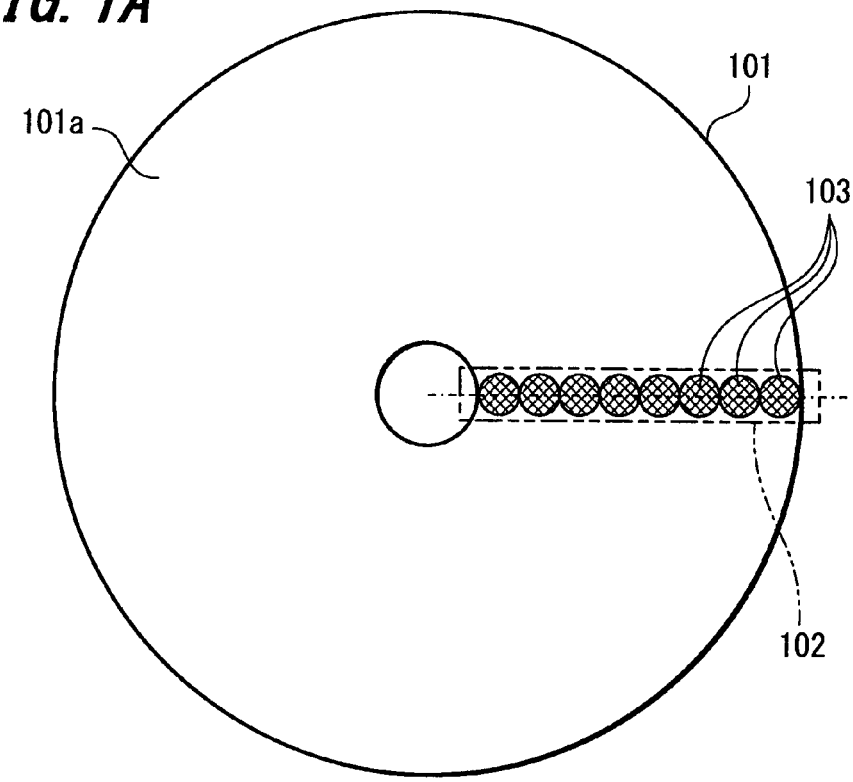
FIGS. 1A and 1B are diagrams for explaining printing carried out when the angular velocity of a printed object and the ejection timing of ink droplets are both constant, with FIG. 1A showing a state immediately after the ink droplets have been ejected from a print head and FIG. 1B showing the state where the ink droplets shown in FIG. 1A have landed on the printed object.
Figure 1B:
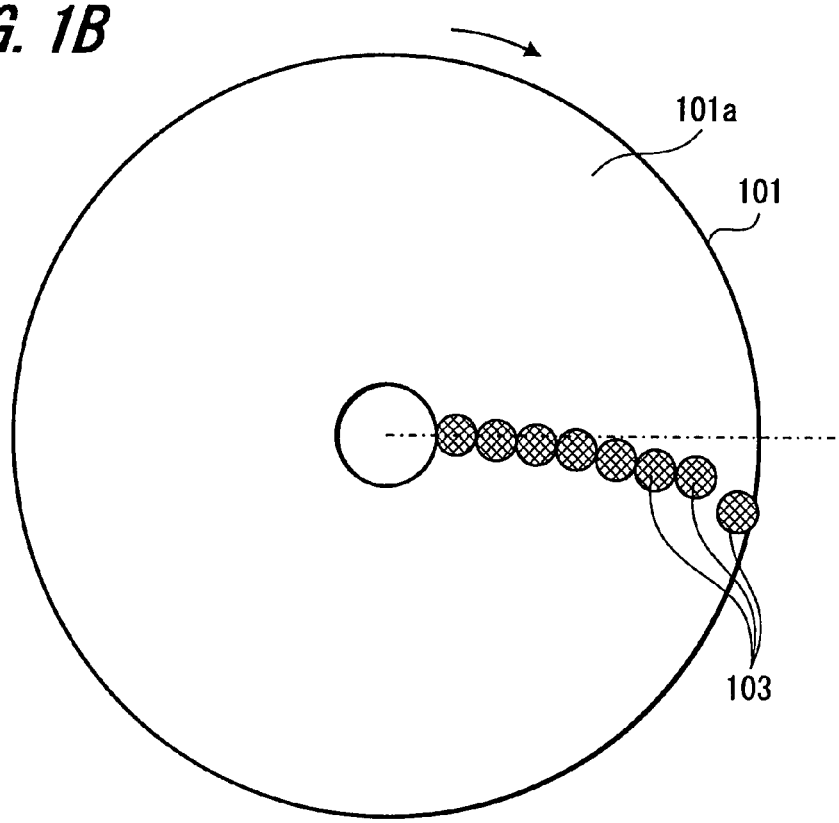
Figure 2:
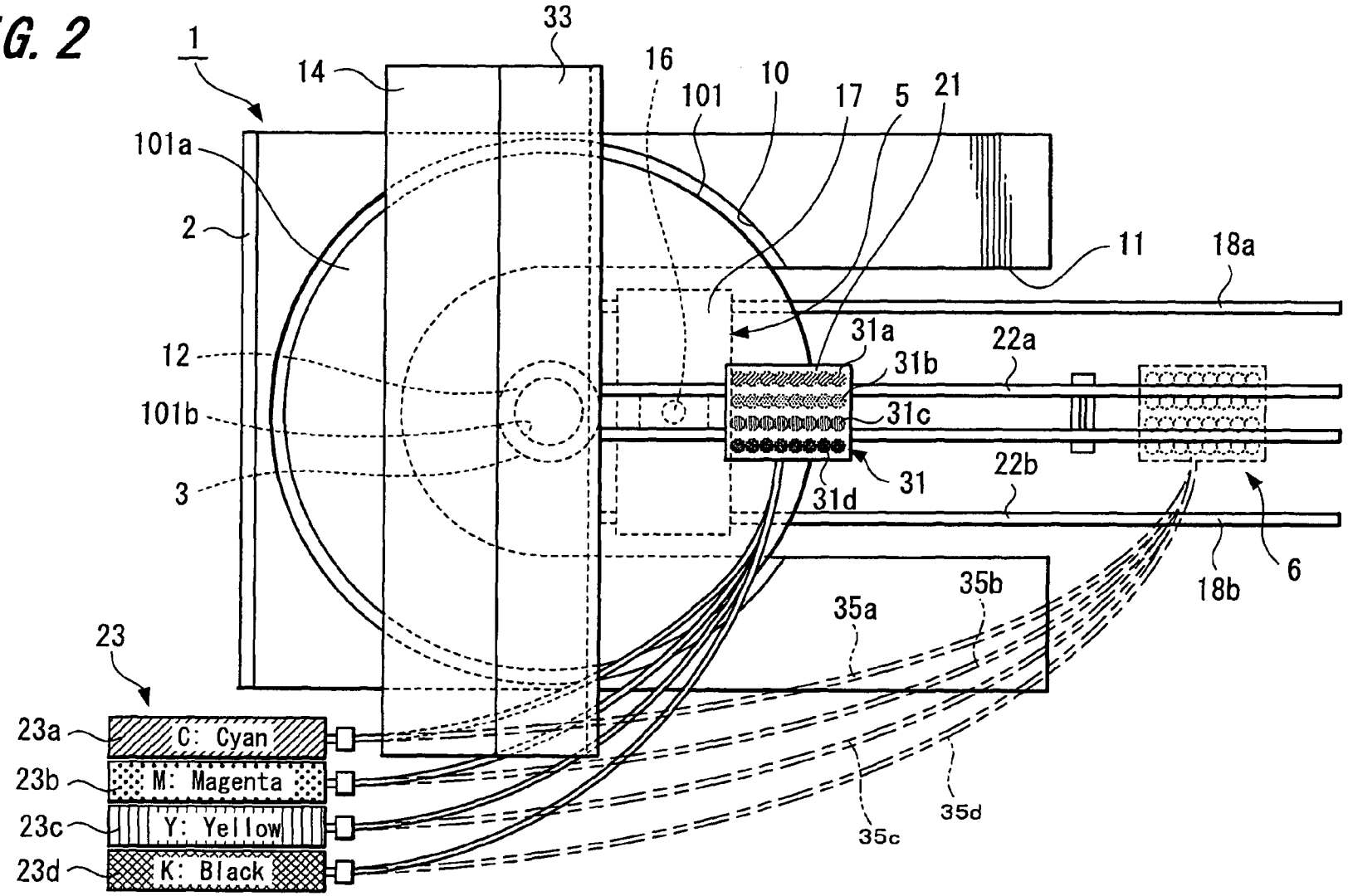
FIG. 2 is a plan view of an optical disc apparatus showing a first embodiment of a print apparatus according to the present invention.
Figure 3:
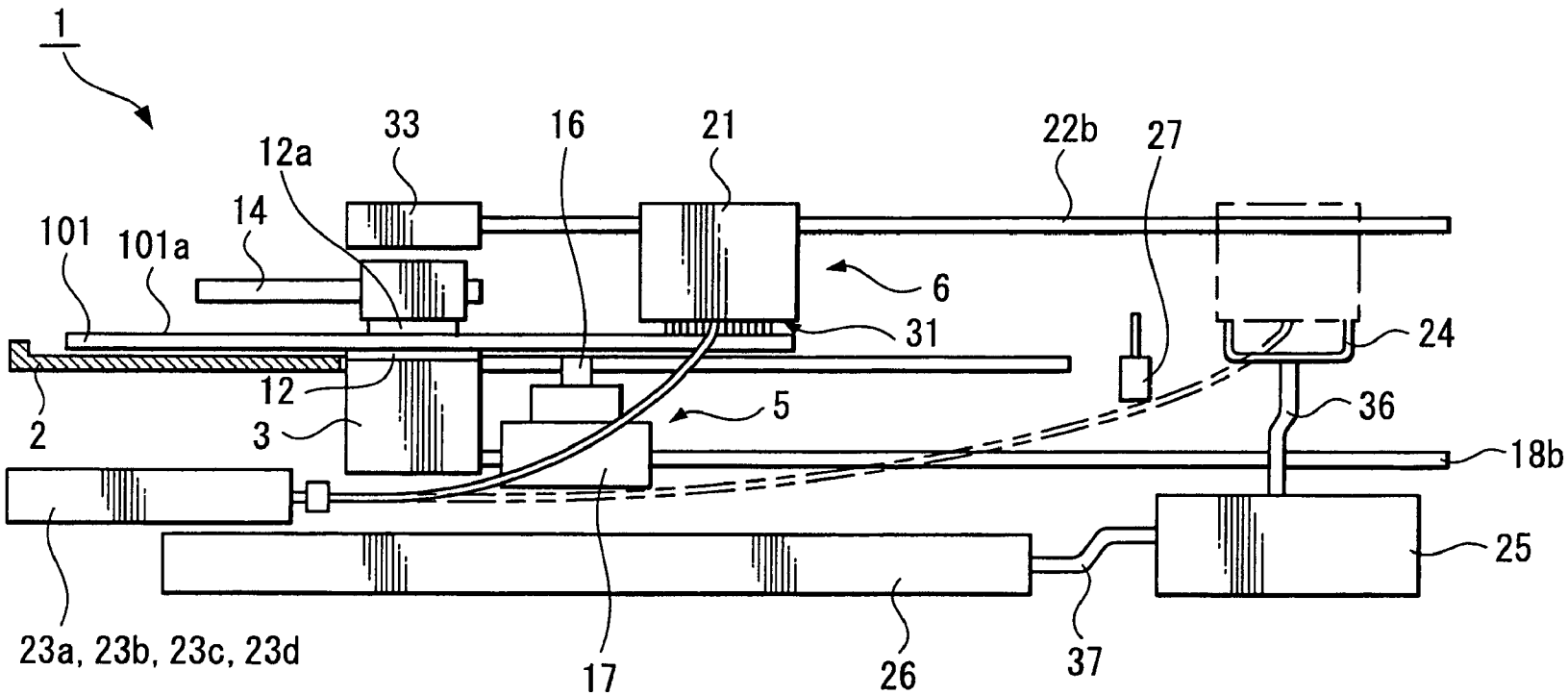
FIG. 3 is a front view of the optical disc apparatus showing the first embodiment of a print apparatus according to the present invention.
Figure 4:
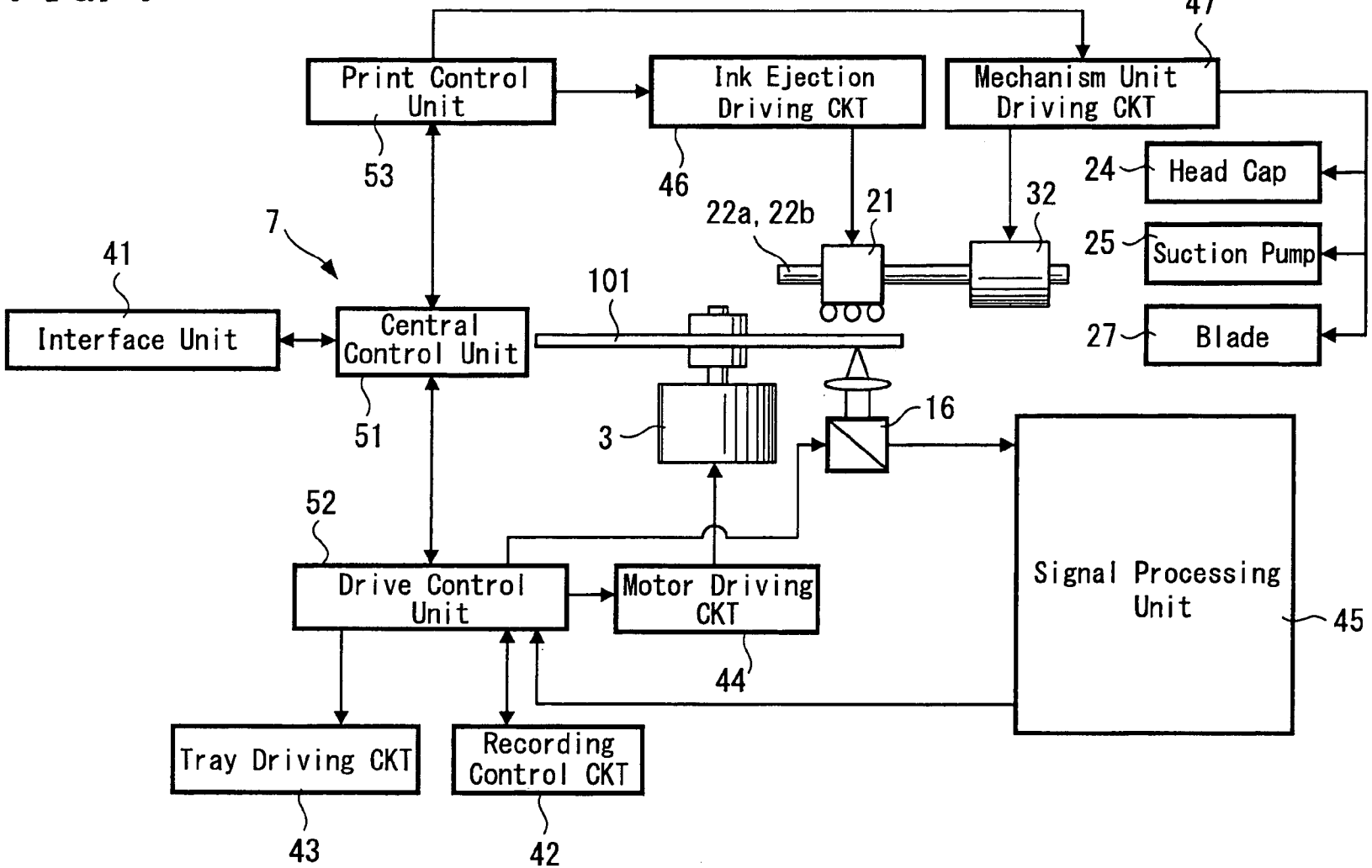
FIG. 4 is a block diagram showing the flow of signals in the optical disc apparatus that is the first embodiment of a print apparatus according to the present invention.
Figure 5:
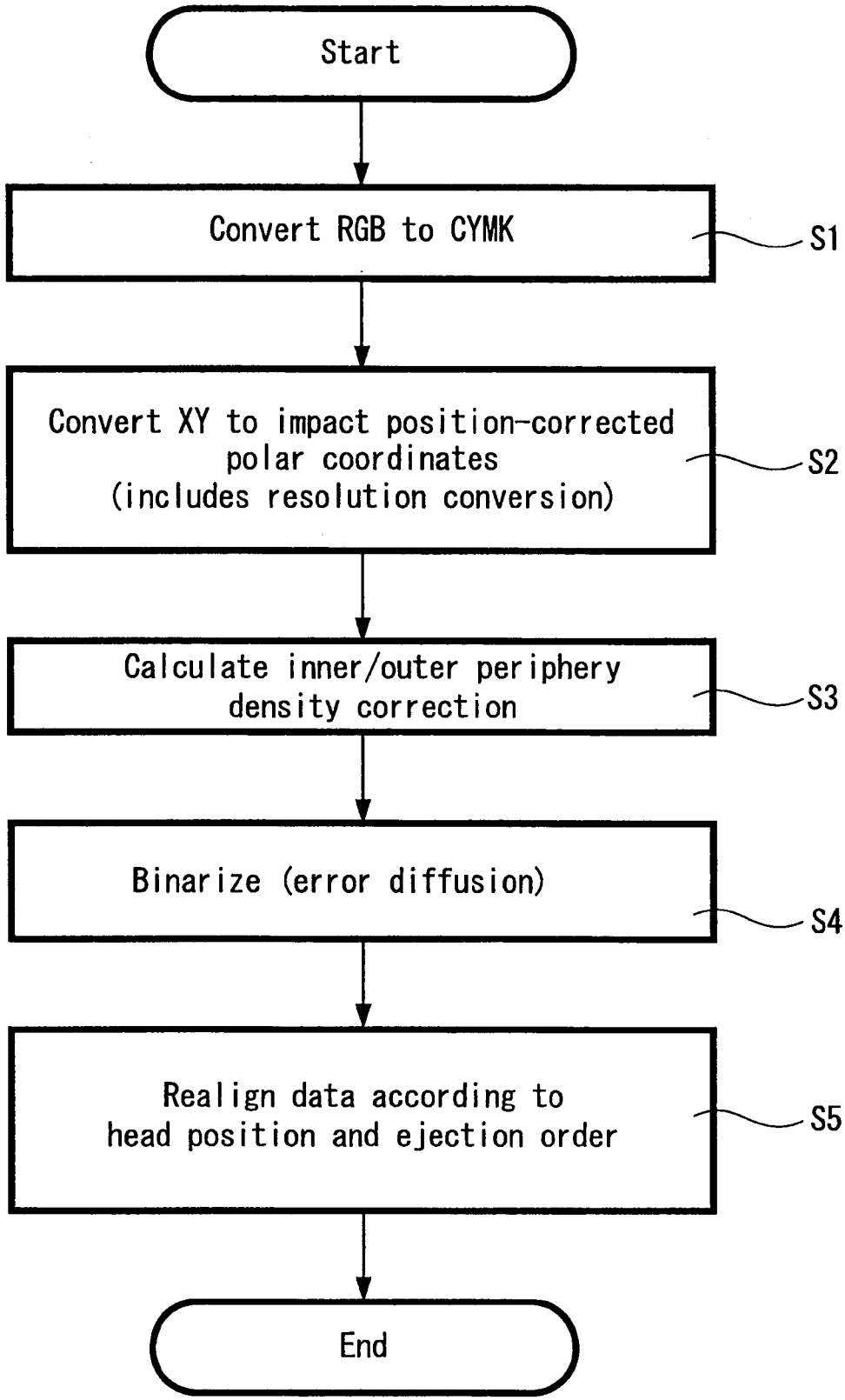
FIG. 5 is a flowchart showing the flow of operations by a control unit of the print apparatus according to an embodiment of the present invention and is used for explaining a process that generates ink ejection data based on visible information.
Figures 6A, 6B, 6C:
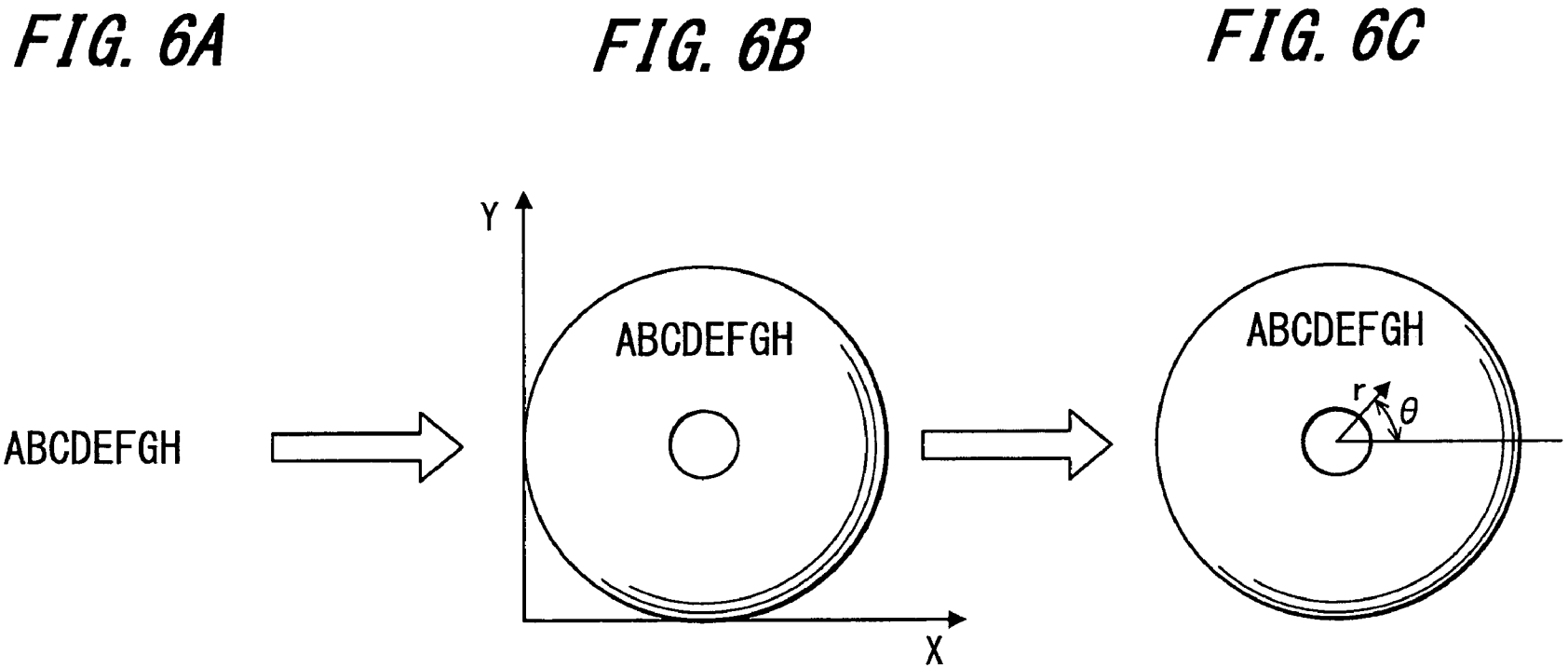
FIGS. 6A to 6C are diagrams for explaining a conversion from biaxial perpendicular coordinate data to polar coordinate data carried out by the print apparatus according to an embodiment of the present invention.
Figure 7A:
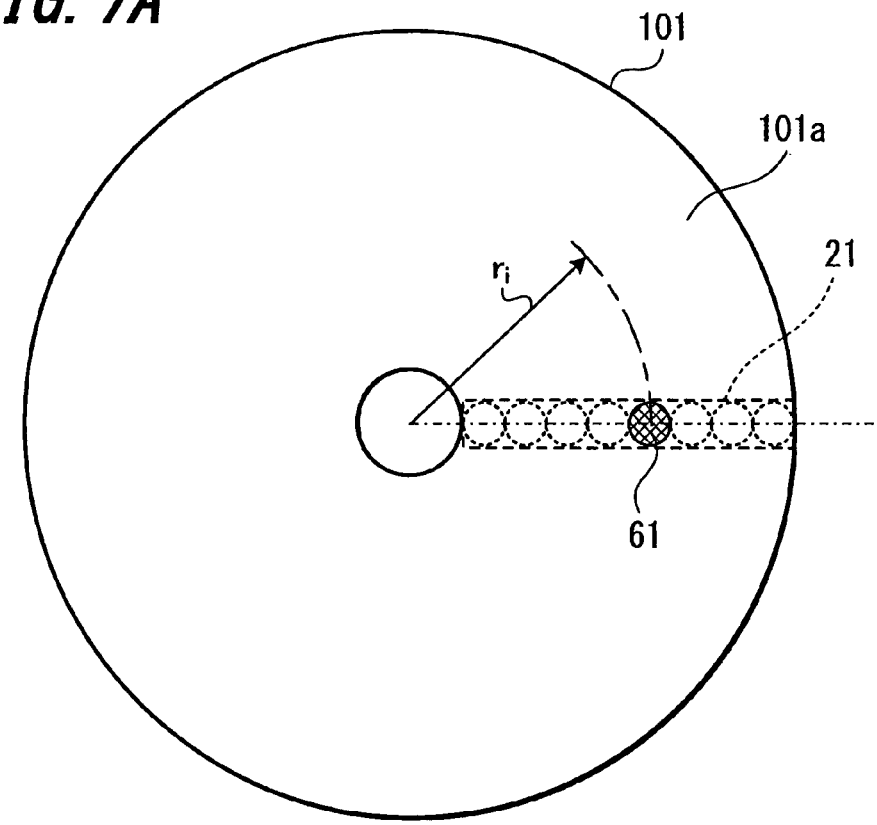
FIGS. 7A and 7B are diagrams for explaining impact position correction carried out by the print apparatus according to a first embodiment of the present invention, with FIG. 7A being a diagram showing the state where ink droplets have been ejected from the print head and FIG. 7B being a diagram showing displacements in the impact positions when the ink droplets shown in FIG. 7A have landed on the printed object.
Figure 7B:
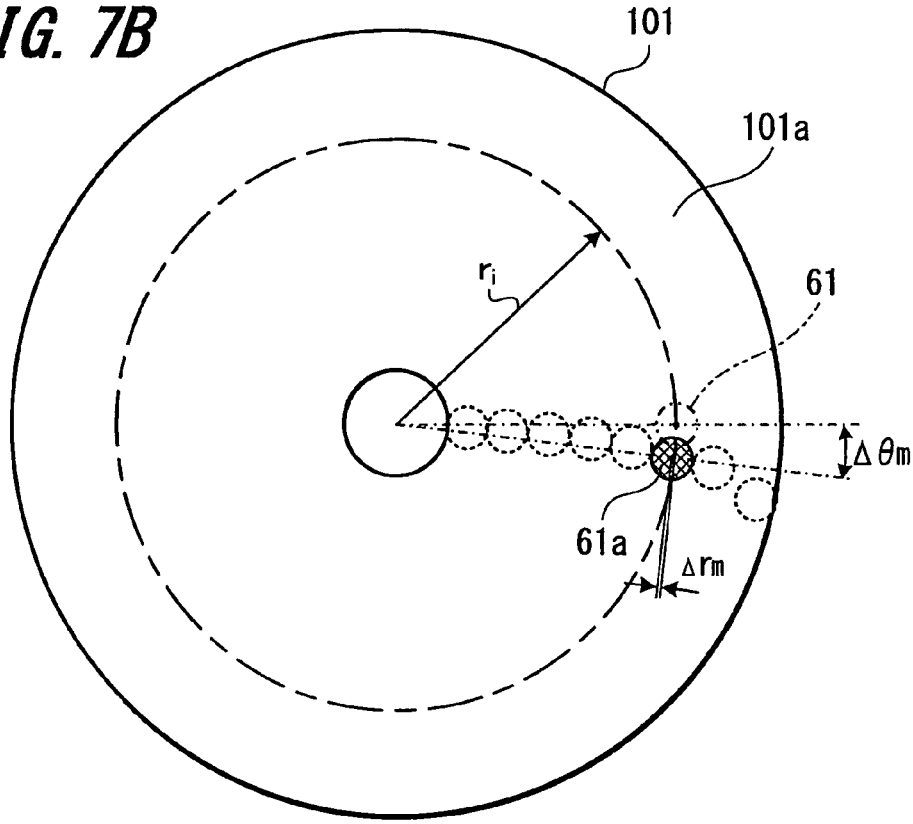
Figure 8:
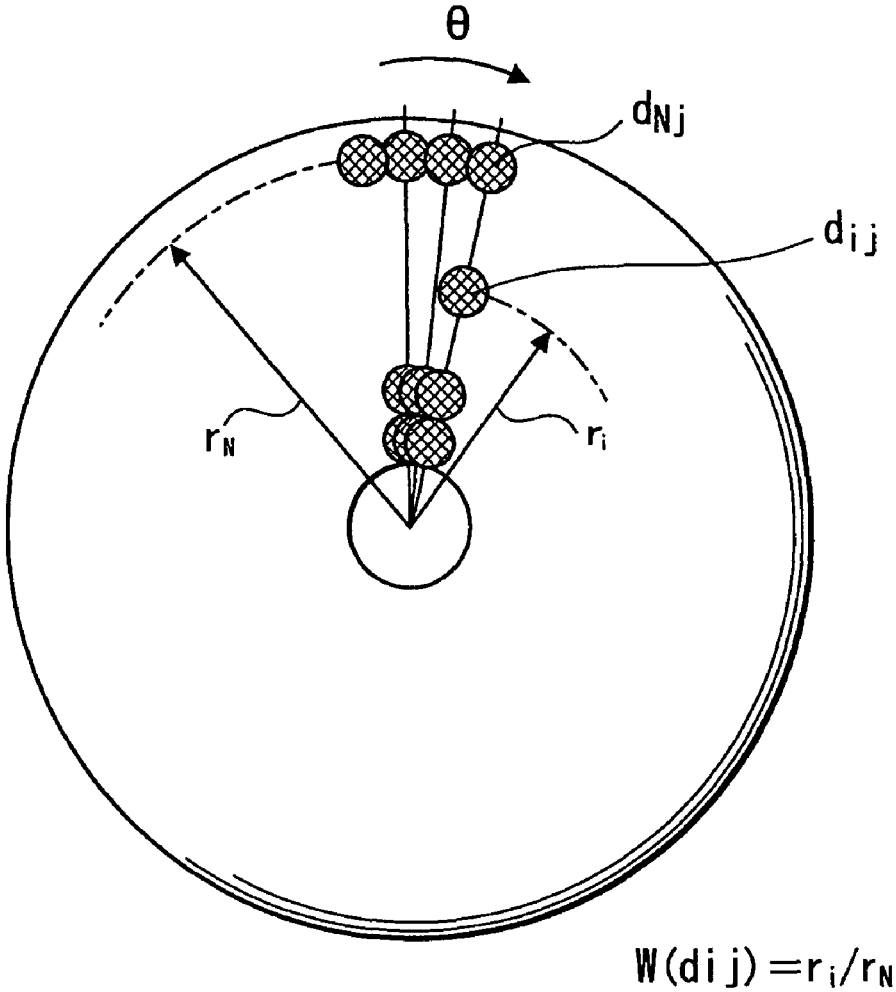
FIG. 8 is a diagram for explaining an approximate calculation of correction weightings carried out by the print apparatus according to an embodiment of the present invention.

FIGS. 2 to 11B are diagrams for explaining embodiments of the present invention. FIGS. 2 to 9 show a first embodiment of a print apparatus and a print method according to the present invention. FIG. 2 is a plan view. FIG. 3 is a front view. FIG. 4 is a block diagram showing the flow of signals. FIG. 5 is a flowchart showing the flow of operations in a control unit. FIGS. 6A to 6C are diagrams for explaining a conversion from biaxial perpendicular coordinate data to polar coordinate data. FIGS. 7A and 7B are diagrams for explaining impact position correction that corrects displacements in the impact positions of ink droplets. FIG. 8 is a diagram for explaining correction weightings for dot density correction. FIGS. 9A to 9F are diagrams for explaining a process as far as generation of ink ejection data from impact position-corrected polar coordinate data.

Figure 10B:
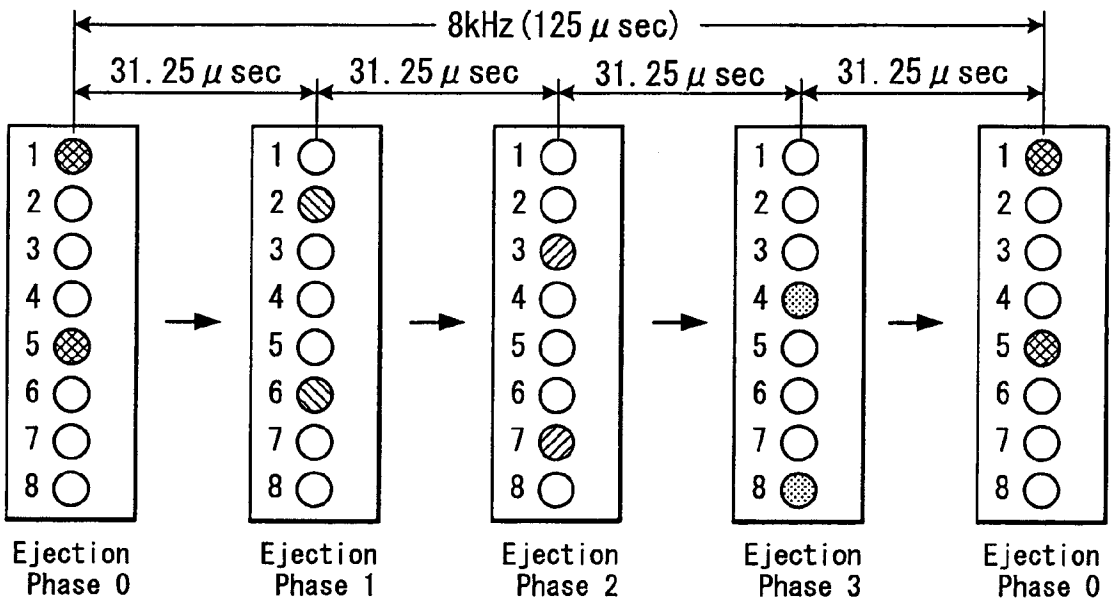
FIGS. 10A and 10B are diagrams for explaining a print apparatus that is a second embodiment of the present invention, with FIG. 10A showing a print head and FIG. 10B showing the ejection timings of the ink droplets ejected from the print head shown in FIG. 10A.
Figure 10A:
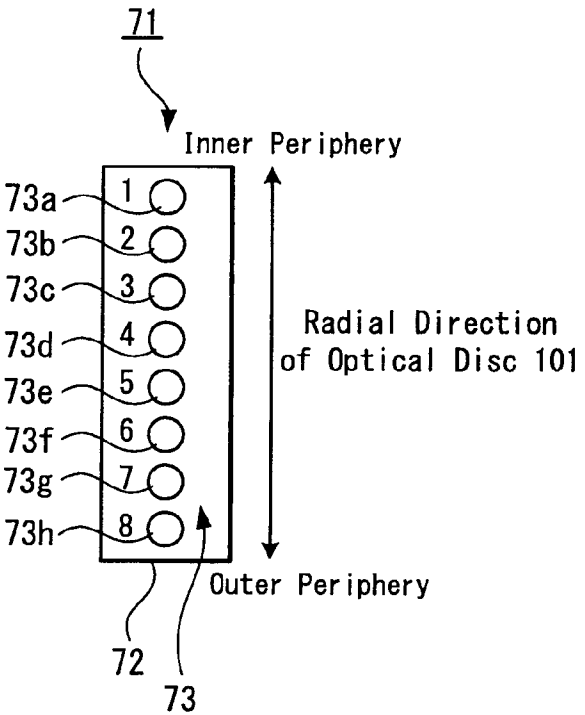
Figure 11A:
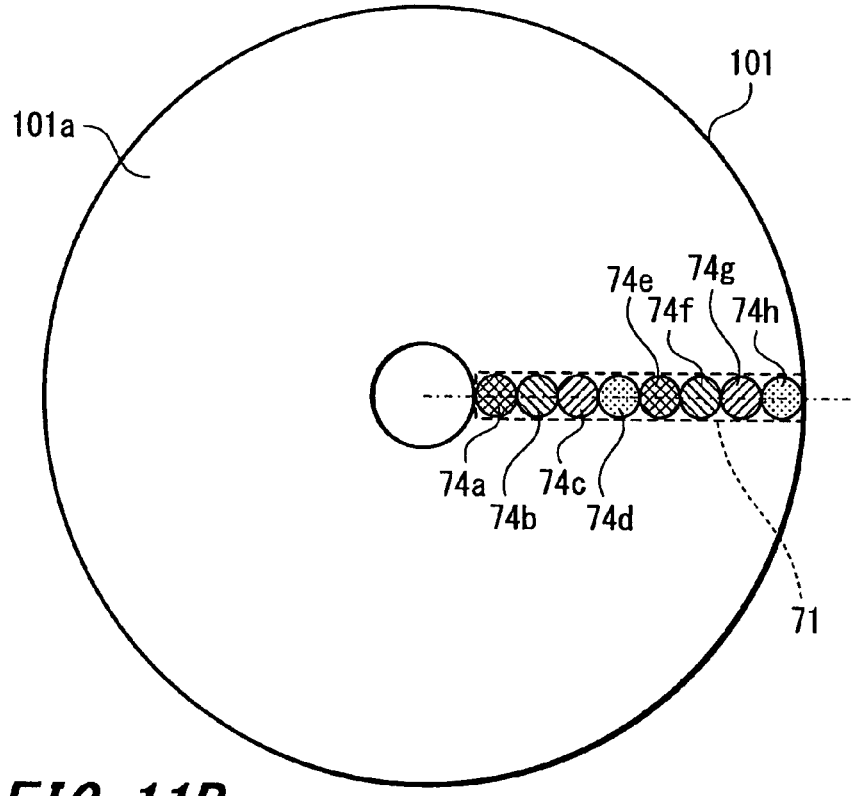
FIGS. 11A and 11B are diagrams for explaining impact position correction carried out by the print apparatus according to a second embodiment of the present invention, with FIG. 11A showing impact positions of ink droplets that have been ejected from the print head at the same timing and FIG. 11B showing the impact positions of ink droplets that have been ejected from the print head at different timings.
Figure 11B:
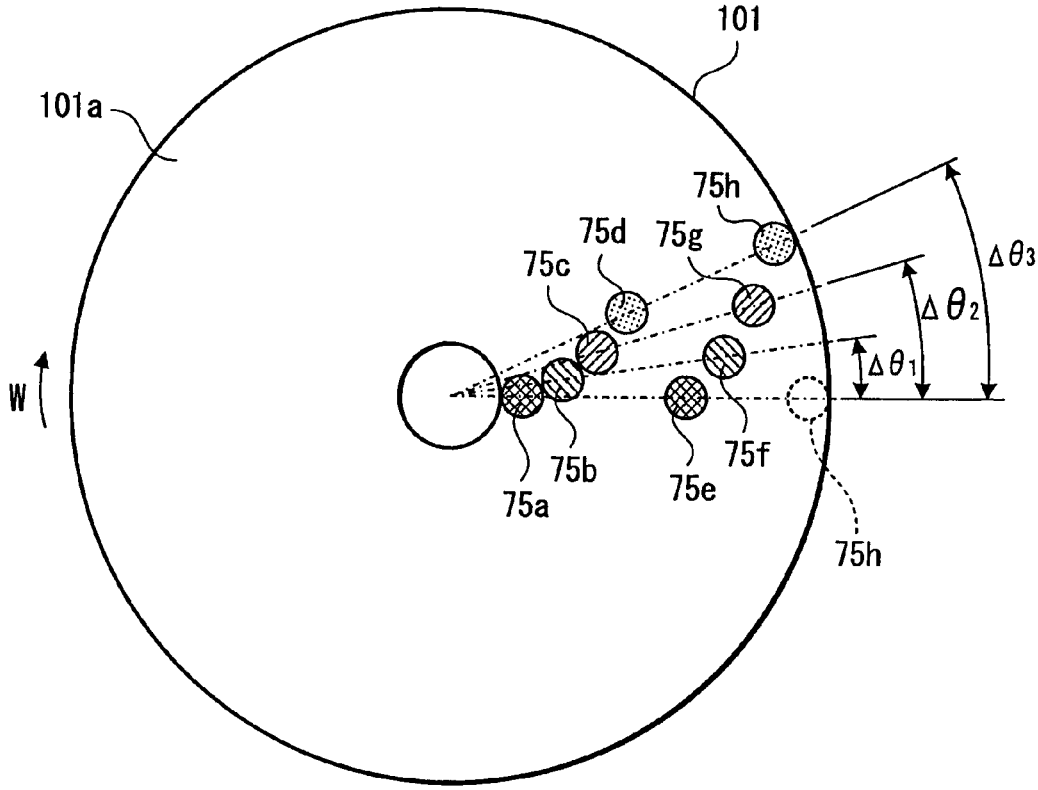

FIGS. 10A, 10B and 11A, 11B are diagrams for explaining a second embodiment of a print method according to the present invention. FIG. 10A is a diagram for explaining a print head. FIG. 10B is a diagram for explaining the ejection timings of ink droplets. FIG. 11A is a diagram for explaining the impact positions of ink droplets ejected at the same timing. FIG. 11B is a diagram for explaining the impact positions of ink droplets ejected at different timings.

FIGS. 2 and 3 show an optical disc apparatus 1 (recording medium driving apparatus) that is a first embodiment of a print apparatus according to the present invention. The optical disc apparatus 1 is capable of recording (writing) a new information signal onto and/or reproducing (reading) an information signal that has been recorded in advance from an information recording surface (or simply "recording surface") of an optical disc 101, such as a CD-R or DVD-RW, as a specific example of a "printed object". The optical disc apparatus 1 is also capable of printing visible information, such as characters and designs, on a label surface (or "main surface") 101*a* of the optical disc 101 that is a specific example of a "print surface".

As shown in FIGS. 2 to 4, the optical disc apparatus 1 includes a tray 2, a spindle motor 3, a recording and/or reproducing unit 5, a print unit 6, a control unit 7, and the like. The tray 2 conveys the optical disc 101. The spindle motor 3 is a specific example of a "disc rotating unit" for rotating the optical disc 101 that has been conveyed by the tray 2. The recording and/or reproducing unit 5 writes and/or reads information onto or from the information recording surface of the optical disc 101 rotated by the spindle motor 3. The print unit 6 prints visible information such as characters and images on the label surface 101*a* of the rotated optical disc 101. The control unit 7 controls the recording and/or reproducing unit 5, the print unit 6, and the like.

The tray 2 of the optical disc apparatus 1 is formed of a plate-shaped member that is rectangular in planar form and slightly larger than the optical disc 101. A disc holding portion 10 formed of a circular concave portion for holding the optical disc 101 is provided in an upper surface that is one of the large flat surfaces of the tray 2. The tray 2 is also provided with a cutaway portion 11 to avoid contact with the spindle motor 3 and the like. The cutaway portion 11 is formed in a wide shape from one of the shorter edges of the tray 2 to a central part of the disc holding portion 10.

The tray 2 is capable of being moved by a tray moving mechanism, not shown, along the length of the tray 2 in the plane of the tray 2. Accordingly, the tray 2 is selectively conveyed to one of a disc loading/unloading position where the tray 2 is outside a main body of the apparatus and a disc attachment position where the tray 2 is inserted inside a main body of the apparatus. When the tray 2 has been moved to the disc loading/unloading position, the user can place an optical disc 101 on the disc holding portion 10 of the tray 2 or remove an optical disc 101 that has been placed upon the disc holding portion 10. Conversely, when the tray 2 has been moved to the disc attachment position, an optical disc 101 placed upon the disc holding portion 10 is attached to a turntable 12, described later, of the spindle motor 3.

The spindle motor 3 is fixed to a motor base, not shown, so as to be positioned facing a substantially central part of the disc holding portion 10 of the tray 2 when the tray 2 has been conveyed to the disc attachment position. The turntable 12 is provided at a front end of the rotational shaft of the spindle motor 3. The turntable 12 includes a disc engagement portion 12*a* that detachably engages a center hole 101*b* of the optical disc 101.

When the tray 2 has been conveyed to the disc attachment position, the spindle motor 3 is moved upward by raising the motor base using a raising and lowering mechanism, not shown. The disc engagement portion 12*a* of the turntable 12 then engages the center hole 101*b* of the optical disc 101 so that the optical disc 101 is lifted by a predetermined distance from the disc holding portion 10. Accordingly, it becomes possible to rotate the optical disc 101 together with the turntable 12, so that the optical disc 101 can be rotated by rotationally driving the spindle motor 3.

Also, by operating the raising and lowering mechanism in the opposite direction to lower the motor base, the disc engagement portion 12*a* of the turntable 12 is removed downward from the center hole 101*b* of the optical disc 101. Accordingly, the optical disc 101 is placed on the disc holding portion 10. In this state, by operating the tray moving mechanism, the tray 2 is moved in a direction away from the spindle motor 3 so that the front portion of the tray 2 protrudes by a predetermined distance out of the apparatus housing.

A chucking portion 14 is provided above the spindle motor 3. The chucking portion 14 presses the optical disc 101, which has been lifted by the raising and lowering mechanism of the spindle motor 3, from above. In this way, the optical disc 101 is sandwiched between the chucking portion 14 and the turntable 12, thereby preventing the optical disc 101 from coming off the turntable 12.

The recording and/or reproducing unit 5 includes an optical pickup 16, a pickup base 17 on which the optical pickup 16 is mounted, and a pair of first guide shafts 18*a*, 18*b* that guide the pickup base 17 in the radial direction of the optical disc 101.

The optical pickup 16 is a specific example of a reading unit that reads information from the optical disc 101 that is a recording medium. The optical pickup 16 includes a light detector, an objective lens, and a biaxial actuator that moves the objective lens close to the information recording surface of the optical disc 101. The light detector of the optical pickup 16 is formed of a semiconductor laser as a light source that emits a light beam and a light-receiving element that receives a return light beam. The optical pickup 16 has a light beam emitted from the semiconductor laser and focuses the light beam onto the information recording surface of the optical disc 101 using the objective lens, and receives a return light beam that has been reflected by the information recording surface via the light detector. Accordingly, the optical pickup 16 can record (write) an information signal or reproduce (read) an information signal that has previously been recorded on the information recording surface.

The optical pickup 16 is mounted on the pickup base 17 and moves together with the pickup base 17. The two guide shafts 18*a*, 18*b* are disposed in parallel to the radial direction of the optical disc 101, which in the present embodiment is the direction in which the tray 2 moves, and are slidably inserted through the pickup base 17. In addition, the pickup base 17 can be moved along the two guide shafts 18*a*, 18*b* by a pickup moving mechanism including a pickup motor, not shown. When the pickup base 17 moves, an operation that records and/or reproduces an information signal on the information recording surface of the optical disc 101 is carried out using the optical pickup 16.

As one example, it is possible to use a feed screw mechanism as the pickup moving mechanism that moves the pickup base 17. However, the pickup moving mechanism is not limited to a feed screw mechanism, and as other examples, it is also possible to use a rack and pinion mechanism, a belt feed mechanism, a wire feed mechanism, or other type of mechanism.

The print unit 6 includes a print head 21, a pair of second guide shafts 22*a*, 22*b*, an ink cartridge 23, a head cap 24, a suction pump 25, a waste ink collection unit 26, and a blade 27.

The print head 21 is positioned opposite the label surface 101*a* of the optical disc 101. A plurality of ejection nozzles 31 that eject ink droplets are provided on a surface of the print head 21 that faces the label surface 101*a*. The plurality of ejection nozzles 31 are disposed in four rows that are aligned in the direction in which the print head 21 moves and are set so that ink droplets of a predetermined color are ejected in each row. In the present embodiment, ejection nozzles 31*a* for cyan (C), ejection nozzles 31*b* for magenta (M), ejection nozzles 31*c* for yellow (Y), and ejection nozzles 31*d* for black (K) are disposed in that order from the top in FIG. 2. Also, to remove thickened ink, bubbles, foreign matter, and the like from the ejection nozzles 31*a* to 31*d*, the print head 21 carries out a "dummy ejection" of ink before printing and after printing.

The two second guide shafts 22*a*, 22*b* that are parallel are slidably passed through the print head 21. The print head 21 is capable of being moved along the two second guide shafts 22*a*, 22*b* by a head moving mechanism including a head driving motor 32 (see FIG. 4). A guide shaft support member 33 that extends in a direction perpendicular to the direction in which the tray 2 moves is fixed to one end in the axial direction of each of the two second guide shafts 22*a*, 22*b* and the other ends of the second guide shafts 22*a*, 22*b* extend to the opposite side to the direction in which the tray 2 moves. The print head 21 is constructed so as to be withdrawn to a standby position located on the outside in the radial direction of the optical disc 101 when printing is not being carried out.

The ink cartridge 23 is provided with a cyan (C) ink cartridge 23*a*, a magenta (M) ink cartridge 23*b*, a yellow (Y) ink cartridge 23*c*, and a black (K) ink cartridge 23*d* corresponding to inks of the respective colors cyan (C), magenta (M), yellow (Y), and black (K). These ink cartridges 23*a* to 23*d* respectively supply ink to the ejection nozzles 31*a* to 31*d* of the print head 21.

The ink cartridges 23*a* to 23*d* each include a hollow vessel and store ink using the capillary action of a porous material enclosed inside the vessel. Connecting portions 35*a* to 35*d* are detachably connected to the openings of the ink cartridges 23*a* to 23*d* so that the ink cartridges 23*a* to 23*d* are connected to the ejection nozzles 31*a* to 31*d* of the print head 21 via the connecting portions 35*a* to 35*d*. Hence, when the ink inside a vessel has been used up, it is possible to easily detach the connection portion from the ink cartridge in question and replace the ink cartridge with a new ink cartridge.

The head cap 24 is provided at the standby position of the print head 21 and is attached to the surface of the print head 21 on which the plurality of ejection nozzles 31 are provided when the print head 21 has moved to the standby position. Accordingly, it is possible to prevent the ink included in the print head 21 from drying and to prevent dust, dirt, and the like from adhering to the respective ejection nozzles 31*a* to 31*d*. The head cap 24 includes a porous layer and temporarily stores ink that has been dummy ejected by the print head 21 from the respective ejection nozzles 31*a* to 31*d*. When doing so, the internal pressure of the head cap 24 is adjusted by a valve mechanism, not shown, so as to be equal to atmospheric pressure.

The suction pump 25 is connected to the head cap 24 via a tube 36. When the head cap 24 is attached to the print head 21, the suction pump 25 applies a negative pressure to the internal space of the head cap 24. As a result, the ink inside the respective ejection nozzles 31*a* to 31*d* of the print head 21 and ink that has been dummy ejected by the print head 21 and temporarily stored in the head cap 24 are removed by suction. The waste ink collection unit 26 is connected to the suction pump 25 via a tube 37 and collects the ink that has been sucked out by the suction pump 25.

The blade 27 is disposed between the standby position and the print position of the print head 21. When the print head 21 moves between the standby position and the print position, the blade 27 contacts the respective front end surfaces of the ejection nozzles 31*a* to 31*d* and wipes away ink, dust, dirt, and the like that adhere to the front end surfaces. Note that by providing a moving mechanism that moves the blade 27 up and down, it is also possible to obtain a construction where it is possible to select whether the ejection nozzles 31*a* to 31*d* of the print head 21 are wiped.

FIG. 4 is a block diagram showing the flow of signals in the optical disc apparatus 1. The optical disc apparatus 1 includes the control unit 7, an interface unit 41, a recording control circuit 42, a tray driving circuit 43, a motor driving circuit 44, a signal processing unit 45, an ink ejection driving circuit 46, and a mechanism unit driving circuit 47.

The interface unit 41 is a connection unit for electrically connecting an external apparatus, such as a personal computer or a DVD recorder, to the optical disc apparatus 1. The interface unit 41 outputs signals supplied from the external apparatus to the control unit 7. These signals correspond to "externally stored information" stored by an external apparatus, and examples of such signals include a recording data signal corresponding to information to be recorded on the information recording surface of the optical disc 101 and an image data signal corresponding to visible information to be printed on the label surface 101*a* of the optical disc 101. The interface unit 41 also outputs a reproduction data signal read by the optical disc apparatus 1 from the information recording surface of the optical disc 101 to the external apparatus.

The control unit 7 includes a central control unit 51, a drive control unit 52, and a print control unit 53. The central control unit 51 controls the drive control unit 52 and the print control unit 53. The central control unit 51 outputs a recording data signal supplied from the interface unit 41 to the drive control unit 52. The central control unit 51 also outputs an image data signal supplied from the interface unit 41 and a position data signal supplied from the drive control unit 52 to the print control unit 53.

The drive control unit 52 controls rotation of the spindle motor 3 and the pickup driving motor (not shown) and controls recording of a recording data signal and reproduction of a reproduction data signal by the optical pickup 16. The drive control unit 52 outputs control signals for controlling rotation of the spindle motor 3, the pickup driving motor, and the tray driving motor to the motor driving circuit 44.

The drive control unit 52 also outputs control signals for controlling a tracking servo and a focus servo to the optical pickup 16 so that the light beam emitted from the optical pickup 16 follows a track on the optical disc 101. In addition, the drive control unit 52 outputs the position data signal supplied from the signal processing unit 45 to the central control unit 51.

The recording control circuit 42 carries out an encoding process, modulation, and the like on a reproduction data signal supplied from the drive control unit 52 and outputs the processed reproduction data signal to the drive control unit 52. The tray driving circuit 43 drives the tray driving motor based on control signals supplied from the drive control unit 52. As a result, the disc tray 2 is conveyed into and out of the apparatus housing.

The motor driving circuit 44 drives the spindle motor 3 based on control signals supplied from the drive control unit 52. As a result, the optical disc 101 mounted on the turntable 12 of the spindle motor 3 is rotated. The motor driving circuit 44 also drives the pickup driving motor based on control signals from the drive control unit 52. Accordingly, the optical pickup 16 is moved together with the pickup base 17 in the radial direction of the optical disc 101.

The signal processing unit 45 carries out demodulation, error detection, and the like on an RF (Radio Frequency) signal supplied from the optical pickup 16 to generate a reproduction data signal. Based on the RF signal, the signal processing unit 45 also detects the position data signal as a signal with a specific pattern, such as a synchronization signal, and/or a signal showing position data for the optical disc 101. As examples, this position data signal can be a rotation angle signal showing the rotation angle of the optical disc 101 and a rotation position signal showing the rotation position of the optical disc 101. The reproduction data signal and the position data signal are outputted to the drive control unit 52.

The print control unit 53 controls the print unit 6 which includes the print head 21 and the head driving motor 32 to have printing carried out on the label surface 101*a* of the optical disc 101. The print control unit 53 generates ink ejection data based on the image data obtained according to an image data signal supplied from the central control unit 51. The generation of the ink ejection data is described in detail later in this specification. The print control unit 53 generates control signals that control the print unit 6 based on the generated ink ejection data and the position data signal supplied from the central control unit 51 and outputs the control signals to the ink ejection driving circuit 46 and the mechanism unit driving circuit 47.

The ink ejection driving circuit 46 drives the print head 21 based on control signals supplied from the print control unit 53. As a result, ink droplets are ejected from the ejection nozzles 31 of the print head 21 and drip onto the label surface 101*a* of the optical disc 101 that is being rotated. The mechanism unit driving circuit 47 drives the head cap 24, the suction pump 25, the blade 27, and the head driving motor 32 based on control signals supplied from the print control unit 53. By driving the head driving motor 32, the print head 21 is moved in the radial direction of the optical disc 101.

FIG. 5 is a flowchart showing a process that generates ink ejection data based on visible information. The visible information will now be described. The visible information is handled as image data where a plurality of dots that are split into the respective colors red (R), green (G), and blue (B) are expressed using biaxial perpendicular (X-Y) coordinates, with such dots having tone values that express the luminances of the respective colors. As examples, this visible information is stored on the information recording surface of the optical disc 101 or in a separate external apparatus to the optical disc apparatus 1, and is inputted into the print control unit 53 via the central control unit 51 of the control unit 7.

As shown in FIG. 5, to generate the ink ejection data, the print control unit 53 first converts image data expressed by tone values for the respective colors red (R), green (G), and blue (B) into CYMK data expressed as distributions of dots (pixels) of the respective colors cyan (C), yellow (Y), magenta (M), and black (K) (step S1). The dots that express this CYMK data have tone values that are based on the image data and in the present embodiment the tone values are in a range of 0 to 255, inclusive (i.e., 8-bit values).

Also, the CYMK data is divided into cyan data expressed by a distribution of a plurality of dots whose color is set at cyan (C), yellow data expressed by a distribution of a plurality of dots whose color is set at yellow (Y), magenta data expressed by a distribution of a plurality of dots whose color is set at magenta (M), and black data expressed by a distribution of a plurality of dots whose color is set at black (K). All of such divided data are respectively transferred to the next step, but in the present embodiment, the respective divided data are collectively referred to as "CYMK data".

Next, the print control unit 53 converts the CYMK data expressed by biaxial perpendicular coordinates to polar (r-θ) coordinate data (step S2). When doing so, the print control unit 53 converts the resolution of the CYMK data using a common method such as nearest neighbor, bilinear, or high-cubic to produce polar coordinate data of a suitable size for the label surface 101*a* of the optical disc 101. Note that the converted resolution may be designated by the user or may be automatically set by the print control unit 53.

In addition, when converting the CYMK data expressed by biaxial perpendicular coordinates to polar coordinate data, the print control unit 53 carries out impact position correction to correct displacements in the impact positions of the ink droplets ejected from the print head 21. That is, the print control unit 53 converts the CYMK data expressed by the biaxial perpendicular coordinates to impact position-corrected polar coordinate data.

First, a typical conversion from biaxial perpendicular coordinate data (CYMK data) to the polar coordinate data (i.e., conversion where impact position correction is not carried out) will be described with reference to FIGS. 6A to 6C. As shown in FIG. 6A, as one example, the print control unit 53 converts visible information composed of a character string "ABCDEFGH" to CYMK data. When doing so, the print control unit 53 stores the CYMK data for the character string "ABCDEFGH" as data in a biaxial perpendicular (X-Y) coordinate system in a memory, not shown.

Next, as shown in FIG. 6C, the radius (r) from the rotational center of the optical disc 101 and the angle (θ) expressed relative to the polar axis are calculated according to $$X=r\cos\theta$$

$$Y=r\sin\theta$$

for the coordinates (X,Y) of every dot in the CYMK data expressed in the X-Y coordinate system. Accordingly, the CYMK data expressed by biaxial perpendicular (X-Y) coordinates is converted to polar (r-θ) coordinate data. Note that it is possible to use a common method such as nearest neighbor or linear interpolation.

Next, the impact position correction carried out when converting the biaxial perpendicular coordinate data (CYMK data) to the polar coordinate data will be described with reference to FIGS. 7A and 7B. FIG. 7A shows a plurality of ink droplets ejected from the print head 21 (in this embodiment, eight droplets). As shown in FIG. 7A, the plurality of ink droplets ejected from the print head 21 are aligned in the radial direction of the optical disc 101 and are ejected with the same timing onto the label surface 101*a* of the optical disc 101 that is rotated at a constant rotational velocity.

The plurality of ink droplets ejected at the same timing are affected by air flows produced in the periphery of the rotating optical disc 101 and therefore impact the positions shown in FIG. 7B. That is, the plurality of ink droplets impact positions that are displaced in the radial direction of the optical disc 101 and in an angular direction expressed relative to the polar axis of the optical disc 101. For this reason, when carrying out the conversion from biaxial perpendicular coordinate data (CYMK data) to the polar coordinate data, the print control unit 53 carries out impact position correction to convert the biaxial perpendicular coordinate data (CYMK data) to impact position-corrected polar coordinate data that takes into account the displacements in the positions where the ink droplets land.

As shown in FIG. 7A, the "ink droplet 61" is the ink droplet ejected from the fifth nozzle from the inside in the radial direction of the optical disc 101 on the print head 21. The displacement in the impact position of an impacted ink droplet 61*a* which is the ink droplet 61 after landing on the label surface 101*a* of the optical disc 101 is expressed as a displacement in the radial position of $\Delta r_m$ and a displacement in the angular position of $\Delta\theta_m$. If a dot in the impact position-corrected polar coordinate data corresponding to the ink droplet 61 is expressed as the dot $d_{ij}$ and the coordinates in the biaxial perpendicular coordinate data corresponding to the dot $d_{ij}$ are expressed as (X,Y), the coordinates $(r_i,\theta_j)$ of the dot $d_{ij}$ in the impact position-corrected polar coordinate data are calculated using the expressions below.

$$X=(r_i+\Delta r_m)\cos(\theta_j+\Delta\theta_m)$$

$$Y=(r_i+\Delta r_m)\sin(\theta_j+\Delta\theta_m)$$

Accordingly, the CYMK data expressed using biaxial perpendicular coordinates is converted to impact position-corrected polar coordinate data.

Note that the air flows produced in the periphery of the optical disc 101 are complex flows that depend on the shape of the print head and the internal shape of the apparatus. Hence, the displacements in the impact positions are complex due to the produced air flows. For this reason, the displacements ($\Delta r_m$ and $\Delta\theta_m$) in the impact positions of the ink droplets are measured in advance for each type of optical disc apparatus and the resulting measurement values are stored in a storage unit, not shown, in the print control unit 53. When converting the biaxial perpendicular coordinate data (CYMK data) to polar coordinate data, the print control unit 53 reads appropriate measurement values from the storage unit and converts the biaxial perpendicular coordinate data (CYMK data) to impact position-corrected polar coordinate data.

The measurement values of displacements in the impact positions stored in the storage unit may be values of $\Delta r_m$ and $\Delta\theta_m$ corresponding to every dot in the impact position-corrected polar coordinate data. Alternatively, the values may be values of $\Delta r_m$ and $\Delta\theta_m$ corresponding to a plurality of representative dots out of all of the dots in the impact position-corrected polar coordinate data. In the case where the measurement values of the displacements in the impact positions stored in the storage unit are values of $\Delta r_m$ and $\Delta\theta_m$ corresponding to a plurality of representative dots, the print control unit 53 interpolates the values of $\Delta r_m$ and $\Delta\theta_m$ corresponding to dots aside from the plurality of representative dots based on the values of $\Delta r_m$ and $\Delta\theta_m$ corresponding to the plurality of representative dots.

Next, dot density correction is carried out on the impact position-corrected polar coordinate data to calculate dot correction data (step S3). Here, "dot density correction" refers to a calculation that adds correction weightings to tone values of the dots in the impact position-corrected polar coordinate data. That is, dot density correction is a calculation that reduces the tone values of dots in accordance with how close the dots are to the inner periphery of the impact position-corrected polar coordinate data to adjust the luminance used to express each dot.

The correction weighting used for the dot density correction is calculated based on the ratio of the number of dots per unit area centered on the dot to be weighted to the number of dots per unit area centered on a dot positioned in the outermost periphery of the impact position-corrected polar coordinate data. For example, if the number of dots per unit area centered on a dot $d_{ij}$ to be weighted is expressed as u and the number of dots per unit area centered on a dot $d_{Nj}$ positioned in the outermost periphery of the impact position-corrected polar coordinate data is expressed as v, the weighting $W(d_{ij})$ for the dot $d_{ij}$ is calculated by the following equation.

$$W(d_{ij})=v/u$$

The correction weighting W for each dot is calculated as described above and is stored in a storage unit, not shown. Later, by reading a suitable correction weighting W from the storage unit when carrying out dot density correction, it is possible to apply a correction weighting to each dot. However, if a correction weighting W is calculated for each dot and stored in a memory, there will be an increase in the storage capacity of the memory. For this reason, in the present embodiment, the correction weightings are approximately calculated.

This approximate calculation of the correction weightings will now be described with reference to FIG. 8. In the present embodiment, the correction weightings for the dot density correction are approximately calculated based on the ratio of the radius of the dot to be weighted to the radius of dots positioned in the outermost periphery of the polar coordinate data. That is, as shown in FIG. 8, if the radius of a dot $d_{ij}$ to be weighted is expressed as $r_i$ and the radius of a dot $d_{Nj}$ positioned in the outermost periphery of the polar coordinate data is expressed as $r_N$, the weighting $W(d_{ij})$ for the dot $d_{ij}$ is calculated by the following equation.

$$W(d_{ij})=r_i/r_N$$

For example, if the radius $r_i$ of the dot $d_{ij}$ is 30 mm and the radius $r_N$ of the dot $d_{Nj}$ is 60 mm, the weighting $W(d_{ij})$ for the dot $d_{ij}$ is 0.5.

If the correction weighting W for each dot is calculated as described above, it is possible to use the same correction weighting for dots at the same radius and therefore possible to reduce the number of correction weightings to be stored in the storage unit. As a result, it is possible to reduce the capacity of the storage unit and to reduce the power consumed by the storage unit.

Next, the dot correction data is binarized according to an error diffusion method to generate the ink ejection data (step S4). The generated ink ejection data is data that expresses whether ink droplets are to be ejected at each position corresponding to a dot on the label surface 101*a* of the optical disc 101. In the present embodiment, the tone values of the dots in the dot correction data are expressed as values from 0 to 255 (i.e., 8-bit values) and the tone values of the dots in the ink ejection data that has been binarized according to the error diffusion method are expressed using the values 0 and 255 (i.e., 1-bit values). Ink droplets are dripped onto positions on the label surface 101*a* corresponding to the dots whose tone values are 255 but are not dripped onto positions corresponding to the dots whose tone values are 0.

Figures 9A, 9B, 9C, 9D, 9E, 9F:
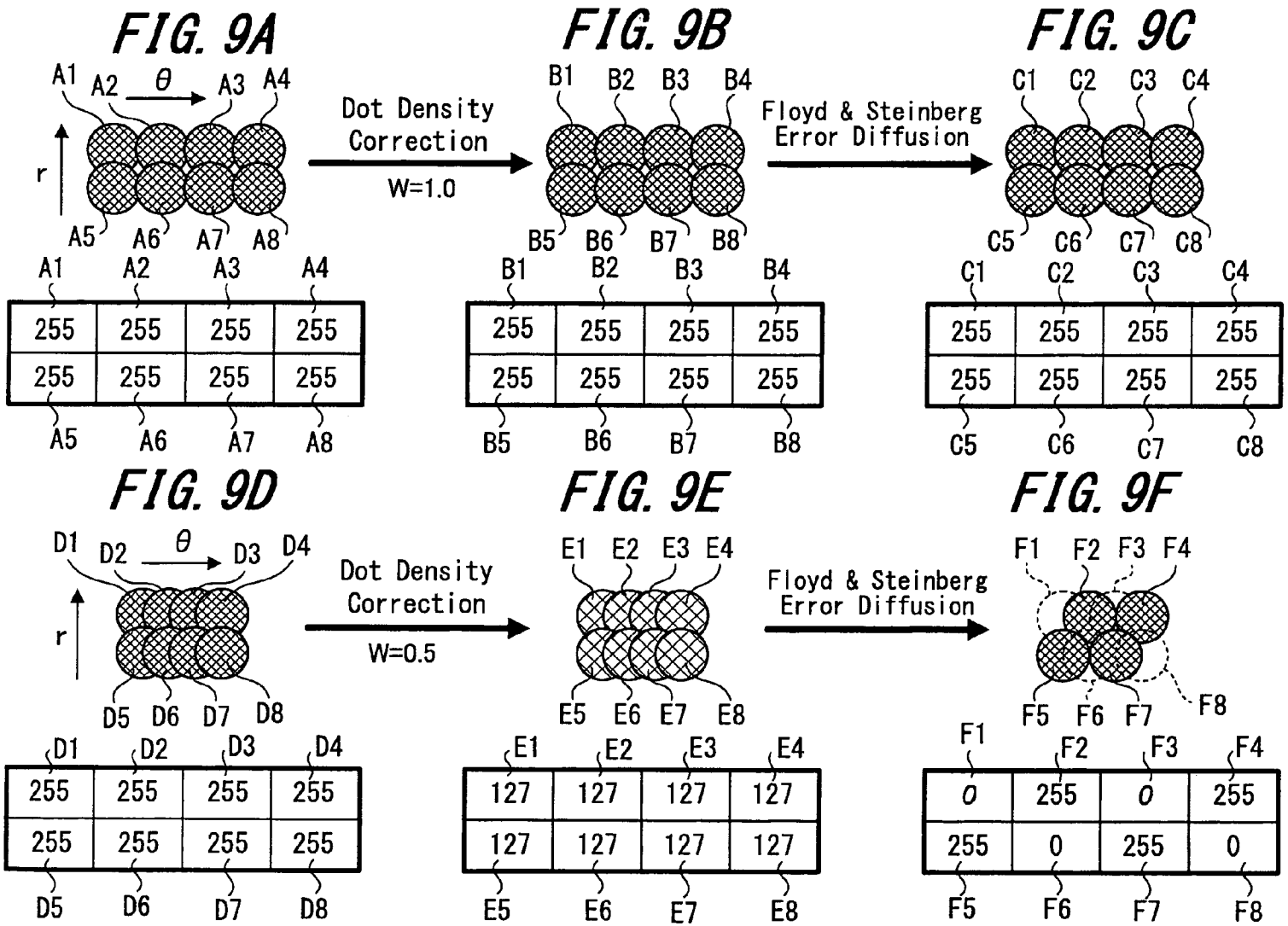
FIGS. 9A to 9F are diagrams for explaining a process whereby the print apparatus according to an embodiment of the present invention generates ink ejection data from impact position-corrected polar coordinate data.

The process up to the generation of the ink ejection data from the impact position-corrected polar coordinate data will now be described with reference to FIGS. 9A to 9F. FIG. 9A shows dots A1 to A4 that are positioned at an outermost periphery of the impact position-corrected polar coordinate data and have a radius value $r_N$ of 60 mm and dots A5 to A8 that are positioned one line inside the dots A1 to A4 and have a radius value $r_{N-1}$ of approximately 60 mm. The tone values of these dots A1 to A8 are all 255.

To generate ink ejection data from the impact position-corrected polar coordinate data, first a correction weighting W is applied to each of the dots A1 to A8 in the impact position-corrected polar coordinate data to calculate the dot correction data. By carrying out the following calculation, $$W(d_{ij})=r_i/r_N$$

the correction weighting $W_N$ for the dots A1 to A4 is calculated as 1.0 and the correction weighting $W_{N-1}$ for the dots A5 to A8 is calculated as approximately 1.0. As a result, as shown in FIG. 9B, the tone values of the dots B1 to B8 in the dot correction data are all 255.

Next, Floyd & Steinberg error diffusion (with a threshold of 128) is carried out on the dots B1 to B8 in the dot correction data to binarize the data and generate ink ejection data as shown in FIG. 9C. As shown in FIG. 9C, the tone values of the dots C1 to C8 of the generated ink ejection data are all 255. As a result, ink droplets are dripped onto positions on the label surface 101*a* of the optical disc 101 that correspond to the dots C1 to C8 in the ink ejection data.

FIG. 9D shows dots D1 to D4 in the polar coordinate data that have a radius $r_i$ of 30 mm and dots D5 to D8 that are positioned one line inside the dots D1 to D4 and have a radius $r_{i-1}$ of approximately 30 mm. The tone values of these dots D1 to D8 are all 255. The correction weighting $W_i$ for the dots D1 to D4 is 0.5 and the correction weighting $W_{i-1}$ for the dots D5 to D8 is approximately 0.5. As a result, as shown in FIG. 9E, the tone values of the dots E1 to E8 in the dot correction data are all 127 (digits following a decimal point are discarded).

Next, Floyd & Steinberg error diffusion (with a threshold of 128) is carried out on the dots E1 to E8 in the dot correction data shown in FIG. 9E to binarize the data and generate ink ejection data as shown in FIG. 9F. As shown in FIG. 9F, the tone values of the dots F1, F3, F6, F8 in the generated ink ejection data become 0 and the tone values of the other dots F2, F4, F5, F7 become 255.

In this way, by generating the ink ejection data by binarization (step S4) according to an error diffusion method after the dot density correction (step S3) has been carried out, it is possible to print the visible information while reducing the ejected number of ink droplets as the distance from the inner periphery of the label surface 101*a* falls. As a result, it is possible to make the print density substantially uniform in the inner and outer peripheries of the label surface 101*a*. Note that the Floyd & Steinberg method and the Jarvis, Judice & Ninke method can be given as examples of such error diffusion method.

Next, the ink ejection data is divided into suitable sizes in accordance with the number of ejection nozzles 31 provided on the print head 21 and sets the order for ejecting the ink droplets (step S5). Note that when a print head that can print on the entire label surface 101*a* during a single revolution of the optical disc 101 is provided, it is possible to omit this process that divides the ink ejection data.

FIGS. 10A and 10B and FIGS. 11A and 11B show an optical disc apparatus (recording medium driving apparatus) as a second embodiment of a print apparatus according to the present invention. This optical disc apparatus has the same construction as the optical disc apparatus 1 according to the first embodiment and only differs in the timing at which the print head 71 ejects ink droplets. For this reason, only the timing at which the print head 71 ejects the ink droplets and the impact position-corrected polar coordinate data corresponding to such timing will be described here.

As shown in FIG. 10A, the print head 71 of the optical disc apparatus that is the second embodiment of a print apparatus includes a plurality of ejection nozzles 73 (eight nozzles in the present embodiment) that are aligned in the radial direction of the optical disc 101. That is, the ejection nozzles 73 are composed of an ejection nozzle 73*a*, an ejection nozzle 73*b*, . . . , that are aligned in order from the inner periphery of the optical disc 101, with an ejection nozzle 73*h* as the outermost nozzle. An example where ink droplets have been simultaneously ejected from the plurality of ejection nozzles 73*a* to 73*h* and the ink droplets have landed on a rotating optical disc 101 is shown in FIG. 11A.

As shown in FIG. 11A, when ink droplets are simultaneously ejected from the plurality of ejection nozzles 73*a* to 73*h* as shown in FIG. 11A, the plurality of ink droplets 74*a* to 74*h* ejected from the ejection nozzles 73*a* to 73*h* will be aligned in a straight line in the radial direction of the optical disc 101. However, when ink droplets are simultaneously ejected from the plurality of ejection nozzles 73*a* to 73*h*, there is an increase in the driving current that flows at a given instant to the print head 21, which may cause a larger power supply to be required. For this reason, in the present embodiment, by shifting the timing at which ink droplets are ejected by nozzles out of the plurality of ejection nozzles 73*a* to 73*h*, the driving current flowing at any given instant is reduced.

As shown in FIG. 10B, in the present embodiment, the timing at which ink droplets are ejected from the plurality of ejection nozzles 73*a* to 73*h* is split into four and two ink droplets are ejected at each timing. For example, the timing at which ink droplets are first ejected is set as "ejection phase 0". In ejection phase 0, ink droplets are ejected from the two ejection nozzles 73*a*, 73*e*. The next timing after ejection phase 0 is set as "ejection phase 1". In ejection phase 1, ink droplets are ejected from the two ejection nozzles 73*b*, 73*f*. In the same way, ink droplets are ejected from the two ejection nozzles 73*c*, 73*g* in ejection phase 2 and ink droplets are ejected from the two ejection nozzles 73*d*, 73*h* in ejection phase 3. An example where ink droplets have been ejected from the four phases 0 to 3 in this way and have landed on a rotating optical disc 101 is shown in FIG. 11B.

As shown in FIG. 11B, when the timing for ejecting the ink droplets is shifted, the plurality of ink droplets 75*a* to 75*h* ejected from the plurality of ejection nozzles 73*a* to 73*h* will impact positions that are shifted in the circumferential direction of the optical disc 101. The displacements in the impact positions of the ink droplets 75*a* to 75*h* will now be described. As shown in FIG. 10B, for example, the print head 71 is driven at 8 kHz (i.e., in 125 μs) to eject ink droplets from ejection phase 0 to ejection phase 3. In this case, the interval (i.e., delay time) between the timings for ejecting ink droplets is 31.25 μs. The delay time of ejection phase 3 relative to ejection phase 0 is 93.75 μs.

If printing is carried out with the optical disc 101 rotated at 500 rpm, the linear velocity of the outermost periphery of an optical disc 101 with a diameter of 120 mm will be 5.0 m/s. Hence, the impact position of the ink droplet 75*h* ejected from the ejection nozzle 73*h* in ejection phase 3 will be displaced by 0.47 mm in the circumferential direction of the optical disc 101 compared to the ink droplet 74*h* ejected in the case where ink droplets are simultaneously ejected from the plurality of ejection nozzles 73*a* to 73*h* shown in FIG. 11A. As a result, the printed visible information becomes distorted, which reduces print quality.

For this reason, the print control unit 53 of the optical disc apparatus 71 generates ink ejection data that compensates for the displacements in the impact positions of the ink droplets 75*b* to 75*d* and ink droplets 75*f* to 75*h* shown in FIG. 11B. That is, when the print control unit 53 converts the biaxial perpendicular coordinate data (CYMK data) to the polar coordinate data in step S2 shown in FIG. 5, impact position correction is carried out to convert the data to impact position-corrected polar coordinate data that compensates for the displacements in the positions impacted by the ink droplets.

As shown in FIG. 11B, the impact positions of the ink droplets 75*b*, 75*f* ejected in ejection phase 1 are displaced by an angle $\Delta\theta_1$ relative to the ink droplets 75*a*, 75*e* ejected in ejection phase 0. In the same way, the impact positions of the ink droplets 75*c*, 75*g* ejected in ejection phase 2 are displaced by an angle $\Delta\theta_2$ and the impact positions of the ink droplets 75*d*, 75*h* ejected in ejection phase 3 are displaced by an angle $\Delta\theta_3$. In this way, if a dot in the impact position-corrected polar coordinate data is expressed as dot $d_{ij}$ and the coordinates of the biaxial perpendicular coordinate data corresponding to the dot $d_{ij}$ are expressed as (X, Y), the coordinates $(r_i, \theta_j)$ of the dot $d_{ij}$ in the impact position-corrected polar coordinate data are calculated according to the equations $$X=r_i \sin(\theta_j+\Delta\theta_n)$$

$$Y=r_i \cos(\theta_j+\Delta\theta_n)$$

where $\Delta\theta_n$ is the displacement in the angular position that occurs in the impact position of the ink droplet corresponding to the $dot_{ij}$ due to a difference in ejection timing. Note that since the process that generates the ink ejection data from the calculated impact position-corrected polar coordinate data is the same as in the first embodiment described earlier, duplicated description thereof is omitted.

The displacement $\Delta\theta_n$ in the angular position that occurs in the impact position of the ink droplet corresponding to the $dot_{ij}$ will now be described. For example, if the rotational angular velocity of the optical disc 101 is expressed as ω, the interval between the timings at which ink droplets are ejected (i.e., the delay time) is set as Δt and the number of the ejection phase that represents the order for ejecting ink droplets is set as n (where n=1, 2, 3, . . . ), $\Delta\theta_n$ is calculated according to the following equation.

$$\Delta\theta_n=n\Delta t\omega$$

When the timing for the ejection of ink droplets is split into four, there are four values of $\Delta\theta_n$ that are $\Delta\theta_0$ (=0°) and $\Delta\theta_1$ to $\Delta\theta_3$, with such values being stored in a storage unit, not shown, of the print control unit 53. Note that it is also possible to store the rotational angular velocity ω of the optical disc 101, the delay time Δt, and phases n representing the order for ejecting the ink droplets in the storage unit, and to calculate $\Delta\theta_n$ at the print control unit 53 according to the equation described above when converting the biaxial perpendicular coordinates (CYMK data) to the impact position-corrected polar coordinate data.

Although in the present embodiment the timing for the ejection of the ink droplets is divided into four, the number into which the ejection timing of the ink droplets is divided according to the present invention is not limited to four. It should be appreciated that the number into which the timing for the ejection of the ink droplets is divided according to an embodiment of the present invention may be three or two, or even five or more.

Next, an optical disc apparatus that is a print apparatus according to a third embodiment of the present invention will now be described. This optical disc apparatus according to the third embodiment of the present invention has the same construction as the optical disc apparatus according to the second embodiment. The impact position correction carried out by the optical disc apparatus according to the third embodiment corrects both the displacements in the impact positions of the ink droplets corrected by the first embodiment and the displacements in the impact positions of the ink droplets corrected by the second embodiment. That is, the displacements in the impact positions corrected by the optical disc apparatus according to the third embodiment are caused by the effect of air flows due to the optical disc 101 rotating and by differences in the timing at which the ink droplets are ejected from respective nozzles out of a plurality of nozzles aligned in the radial direction of the optical disc 101.

If a dot in the impact position-corrected polar coordinate data is expressed as dot $d_{ij}$ and coordinates in the biaxial perpendicular coordinate data corresponding to the dot $d_{ij}$ are expressed as (X, Y), the coordinates $(r_i, \theta_j)$ of the dot $d_{ij}$ in the impact position are calculated according to the following equations $$X=(r_i+\Delta r_m)\cos(\theta_j+\Delta\theta_m+\Delta\theta_n)$$

$$Y=(r_i+\Delta r_m)\sin(\theta_j+\Delta\theta_m+\Delta\theta_n)$$

where $\Delta r_m$: the displacement in the radial position that occurs in the impact position of an ink droplet corresponding to the dot $d_{ij}$ due to air flows, $\Delta\theta_m$: the displacement in the angular position that occurs in the impact position of an ink droplet corresponding to the dot $d_{ij}$ due to air flows, and $\Delta\theta_n$): the displacement in the angular position that occurs in the impact position of an ink droplet corresponding to the dot $d_{ij}$ due to a difference in ejection timing.

Note that since the process that generates the ink ejection data from the calculated impact position-corrected polar coordinate data is the same as in the first embodiment, duplicated description thereof is omitted.

As described above, according to the embodiments of the print method, the print apparatus, and the recording medium driving apparatus of the present invention, when visible information expressed by biaxial perpendicular coordinate data is converted to polar coordinate data, impact position correction that corrects displacements in the impact positions of ink droplets is carried out to convert the data to impact position-corrected polar coordinate data. As a result, it is possible to carry out high-quality printing that compensates for the displacements in the impact positions of the ink droplets and to prevent distortion from occurring in the visible information printed on the printed object.

As described above, according to the embodiments of the print method, the print apparatus, and the recording medium driving apparatus of the present invention, it is possible to carry out dot density correction that adds a correction weighting calculated in accordance with the number of dots per unit area centered on each dot in the impact position-corrected polar coordinate data to the luminance value of each dot. Subsequently, the dot correction data calculated by the dot density correction is binarized by an error diffusion method to generate the ink ejection data. After this, by printing the generated ink ejection data, it is possible to reduce the number of excessively ejected ink droplets as the distance from the inner periphery of the print surface of the printed object falls, which makes it possible to print the visible information with a substantially uniform print density.

The present invention is not limited to the embodiments described above and shown in the drawings and can be subjected to a variety of modifications without departing from the scope of the invention. For example, although an example where an optical disc such as a CD-R or DVD-RW is used as the recording medium has been described in the above embodiments, it is also possible to apply the present invention to a print apparatus where the printed object is a recording medium of another recording method that utilizes a magneto-optical disc, a magnetic disc, or the like. In addition, a print apparatus according to the present invention can be applied to an image pickup apparatus, a personal computer, an electronic dictionary, a DVD player, a car navigation system, or another type of electronic appliance that can use a recording medium driving apparatus such as that described earlier.

It should be understood by those skilled in the art that various modifications, combinations, sub-combinations and alterations may occur depending on design requirements and other factors insofar as they are within the scope of the appended claims or the equivalents thereof.

What is claimed is:

1. A print method that prints visible information by ejecting ink droplets from a print head onto a printed object that is rotated by a rotational driving unit, the print method comprising:

carrying out impact position correction that corrects displacements in impact positions of the ink droplets to convert the visible information to impact position-corrected polar coordinate data when converting the visible information from biaxial perpendicular coordinate data to polar coordinate data;

generating ink ejection data based on the impact position-corrected polar coordinate data; and printing the visible information by ejecting the ink droplets onto the printed object based on the ink ejection data, wherein the ink ejection data is generated by carrying out dot density correction that adds a correction weighting calculated in accordance with a number of dots per unit area to a luminance value of each dot in the impact position-corrected polar coordinate data.

2. A print method according to claim 1, wherein the displacements in the impact positions of the ink droplets are caused by an effect of air flows produced due to the printed object rotating, and if coordinates of the biaxial perpendicular coordinate data corresponding to a dot $d_{ij}$ in the impact position-corrected polar coordinate data are expressed as (X,Y), coordinates $(r_i,\theta_j)$, in the impact position-corrected polar coordinate data are calculated using the following equations $$X=(r_i+\Delta r_m)\cos(\theta_j+\Delta\theta_m)$$

$$Y=(r_i+\Delta r_m)\sin(\theta_j+\Delta\theta_m)$$

where $\Delta r_m$ represents a displacement in the radial position that occurs in the impact position of the ink droplet corresponding to the dot $d_{ij}$ due to the air flows, and $\Delta\theta_m$ represents a displacement in the angular position that occurs in the impact position of the ink droplet corresponding to the dot $d_{ij}$ due to the air flows.

3. A print method according to claim 2, wherein $\Delta r_m$ and $\Delta\theta_m$ are determined according to the impact positions of ink droplets that have been measured in advance and values of $\Delta r_m$ and $\Delta\theta_m$ corresponding to every dot in the impact position-corrected polar coordinate data are stored in a storage unit, and when the biaxial perpendicular coordinate data is converted to impact position-corrected polar coordinate data, $\Delta r_m$ and $\Delta\theta_m$ are read from the storage unit.

4. A print method according to claim 2, wherein $\Delta r_m$ and $\Delta\theta_m$ are determined according to the impact positions of ink droplets that have been measured in advance and values of $\Delta r_m$ and $\Delta\theta_m$ corresponding to a plurality of representative dots out of every dot in the impact position-corrected polar coordinate data are stored in a storage unit, and when the biaxial perpendicular coordinate data is converted to impact position-corrected polar coordinate data, $\Delta r_m$ and $\Delta\theta_m$ corresponding to the plurality of representative dots are read from the storage unit and $\Delta r_m$ and $\Delta\theta_m$ corresponding to dots aside from the plurality of representative dots are interpolated based on the values of $\Delta r_m$ and $\Delta\theta_m$ corresponding to the plurality of representative dots.

5. A print apparatus comprising:

a rotational driving unit that rotates a printed object;

a print head that prints visible information by ejecting ink droplets onto the printed object being rotated by the rotational driving unit; and a control unit that generates ink ejection data based on the visible information and controls the print head based on the ink ejection data, wherein when the control unit converts the visible information, which is expressed using biaxial perpendicular coordinate data, to polar coordinate data, the control unit carries out impact position correction to correct displacements in impact positions of the ink droplets and generate impact position-corrected polar coordinate data, and generates the ink ejection data based on the impact position-corrected polar coordinate data, wherein the ink ejection data is generated by carrying out dot density correction that adds a correction weighting calculated in accordance with a number of dots per unit area to a luminance value of each dot in the impact position-corrected polar coordinate data.

6. A recording medium driving apparatus comprising:

a reading unit to read recorded information from a recording surface of a recording medium;

a rotational driving unit to rotate the recording medium;

a print head to print visible information by ejecting ink droplets onto a label surface of the recording medium being rotated by the rotational driving unit; and a control unit to generate ink ejection data based on the visible information and control the print head based on the ink ejection data and position data for the recording medium obtained from the information read by the reading unit, wherein when the control unit converts the visible information, which is expressed using biaxial perpendicular coordinate data, to polar coordinate data, the control unit carries out impact position correction to correct displacements in impact positions of the ink droplets and generate impact position-corrected polar coordinate data, and generates the ink ejection data based on the impact position-corrected polar coordinate data, wherein the ink ejection data is generated by carrying out dot density correction that adds a correction weighting calculated in accordance with a number of dots per unit area to a luminance value of each dot in the impact position-corrected polar coordinate data.

* * * * *